US009763481B2

(12) United States Patent
Boonen et al.

(10) Patent No.: US 9,763,481 B2
(45) Date of Patent: Sep. 19, 2017

(54) BREASTFEEDING ATTIRE

(71) Applicant: BEAUnen bvba, Hasselt (BE)

(72) Inventors: Eva Elizabeth Boonen, Zoutleeuw (BE); Martine Boonen, Hechtel (BE)

(73) Assignee: BEAUNEN BVBA, Hasselt (BE)

( * ) Notice: Subject to any disclaimer, the term of this patent is extended or adjusted under 35 U.S.C. 154(b) by 282 days.

(21) Appl. No.: 14/585,331

(22) Filed: Dec. 30, 2014

(65) Prior Publication Data

US 2015/0189923 A1 Jul. 9, 2015

(30) Foreign Application Priority Data

Jan. 3, 2014 (BE) ..... 2014/0004

(51) Int. Cl.
*A41D 1/20* (2006.01)
*A41D 1/22* (2006.01)

(52) U.S. Cl.
CPC ..... *A41D 1/205* (2013.01); *A41D 1/22* (2013.01); *A41D 2600/00* (2013.01)

(58) Field of Classification Search
CPC ..... A41D 1/22; A41D 27/13; A41D 1/205
USPC ..... 2/74, 56, 104; 450/36
See application file for complete search history.

(56) References Cited

U.S. PATENT DOCUMENTS 2,414,616 A * 1/1947 Staw ..... A41D 27/13 2/46
3,513,852 A * 5/1970 Seidl ..... A41C 3/04 450/36
4,633,876 A * 1/1987 Scullin ..... A41C 3/04 450/36
6,327,712 B1 * 12/2001 Armstrong ..... A41D 1/205 2/104
8,668,547 B2 3/2014 Boonen et al.
2013/0232661 A1 9/2013 Huntley

FOREIGN PATENT DOCUMENTS

| | | | |
|---|---|---|---|
| EP | 2 022 354 | A1 | 2/2009 |
| GB | 05092 | A | 0/1912 |
| GB | 744393 | A | 2/1956 |
| WO | 2012092655 | A1 | 7/2012 |

OTHER PUBLICATIONS

Belgian Search Report and Written Opinion dated Sep. 2, 2014 in connection with Belgian Patent Application No. BE 2014/0004, 10 pages.

Babybellykelli, entitled "The Arden all-in-one nursing bra," Jan. 21, 2013, URL:https://www.youtube.com/watch?v=sHL_4l7hkEM, 1 page.

Communication European Search Report dated Feb. 17, 2015 by the European Patent Office in connection with European Patent Application No. 14200519.8, 7 pages.

* cited by examiner

*Primary Examiner* — Tejash Patel
(74) *Attorney, Agent, or Firm* — Amster, Rothstein & Ebenstein LLP

(57) ABSTRACT

The present invention relates to breastfeeding attire, more specifically an outer garment which comprises one or more draping flaps which are removably attached from the remainder of said outer garment as to cover and uncover the chest area, wherein said one or more draping flaps are attachable to the remainder of said outer garment in two different asymmetrical configurations.

8 Claims, 12 Drawing Sheets

BREASTFEEDING ATTIRE

CROSS-REFERENCE TO RELATED APPLICATION

This application claims priority to Belgian Patent Application No. 2014/0004, filed Jan. 3, 2014, the contents of which are herein incorporated by reference in their entirety.

TECHNICAL FIELD

The present invention relates to a breastfeeding garment.

BACKGROUND

Most outer clothing does not offer the possibility of breastfeeding in a simple and discreet manner. Although modified breastfeeding attire is available, these garments often do not have a sufficient degree of comfort, functionality, ease of use and/or discretion. Furthermore, the existing breastfeeding attire is usually of a simple design with little aesthetic value. There is therefore a need for improved breastfeeding attire.

SUMMARY

It is an object of the present invention to provide breastfeeding attire which is comfortable to wear and easy to use and, in addition, makes it possible to breastfeed discreetly. More specifically, the present invention relates to an outer garment which comprises one or more draping flaps running across the chest.

The present application describes an outer garment, comprising one or more draping flaps which are removably attached to the remainder of said outer garment as to cover and uncover the chest area, wherein said one or more draping flaps are attachable to the remainder of said outer garment in different configurations so as to close the garment. The outer garment is further characterized in that said configurations differ from each other as to the positioning of a proximal or distal end of one of said one or more draping flaps relative to the rest of said outer garment.

In particular embodiments, the outer garment described herein is a single-piece garment. In specific embodiments, the outer garment is a top or a dress.

In particular embodiments, the outer garment comprises a left-hand and a right-hand draping flap which run across the chest, each having a proximal and distal side, in which, on the one hand, the proximal side of each flap is attached to the remainder of the outer garment at one or more points at or around the chest area and, on the other hand, the distal side of each flap is detachably attached to the remainder of the outer garment under the underarm region at the opposite breast. In these embodiments, the outer garment is moreover characterized by the fact that the draping flaps cross one another in the closed position, in which case it is possible both for the left-hand flap to cross on top of the right-hand flap and vice versa.

In specific embodiments of the outer garment described herein, the distal side of each draping flap is detachably attached to the remainder of the outer garment by means of a closing mechanism, such as for example a press-stud, a button and loop combination or a hook and loop fastener. As will be clear to those skilled in the art, in most cases, one part of the closing mechanism will be provided on the distal side of the draping flap and the other part of the closing mechanism will be provided on the remainder of the outer garment (for example on the parts of the outer garment described further above, such as the front piece, back piece, top part or at a transition between one or more thereof).

In further embodiments of the outer garment described herein, the proximal side of one or both draping flaps or the connection between the proximal side and the remainder of the outer garment is provided with a vertical opening which can give access to a breast for breastfeeding. In more specific embodiments of the outer garment described herein, said vertical opening may be kept closed by a closing mechanism.

In more specific embodiments of the outer garment described herein, the fastening of the proximal side of each of the draping flaps to the remainder of the outer garment is hidden from view by the remainder of the garment.

In particular embodiments, said outer garment has a neckline surrounding the chest area and wherein said garment comprises a single draping flap which is removably attached to the rest of said garment at a plurality of points surrounding said neckline, said draping flap comprising left and right shoulder ends for connecting to the rest of said garment at the left and right side of said neckline respectively, wherein said left and right shoulder ends can independently be positioned on top or behind the edge of said neckline.

In certain embodiments, said draping flap is removably attached to the rest of said garment at a plurality of points at the inner surface of the rest of said garment.

In particular embodiments, said draping flap is removably attached to the rest of said garment via a plurality of press-studs.

In certain embodiments, the garment is provided with a further draping flap which is interchangeable with said single draping flap.

In particular embodiments, the outer surface of said garment is provided with closing mechanisms for attaching said shoulder ends, wherein said closing mechanisms are covered by a cover element.

In certain embodiments, said draping flap is provided with a plurality of folds when attached to the remainder of said garment.

In specific embodiments, the garments according to the present invention have the advantages that they make it possible to breastfeed in a simple and discreet way and that they may help to remind the wearer which breast was last used for breastfeeding. Furthermore, the garments described herein are elegant and comfortable to wear, also during pregnancy.

DESCRIPTION OF THE FIGURES

The following description of the figures of specific embodiments of the invention is only given by way of example and is not intended to limit the present explanation, its application or use. In the drawings, identical reference numerals refer to the same or similar parts and features.

Figure 1A:
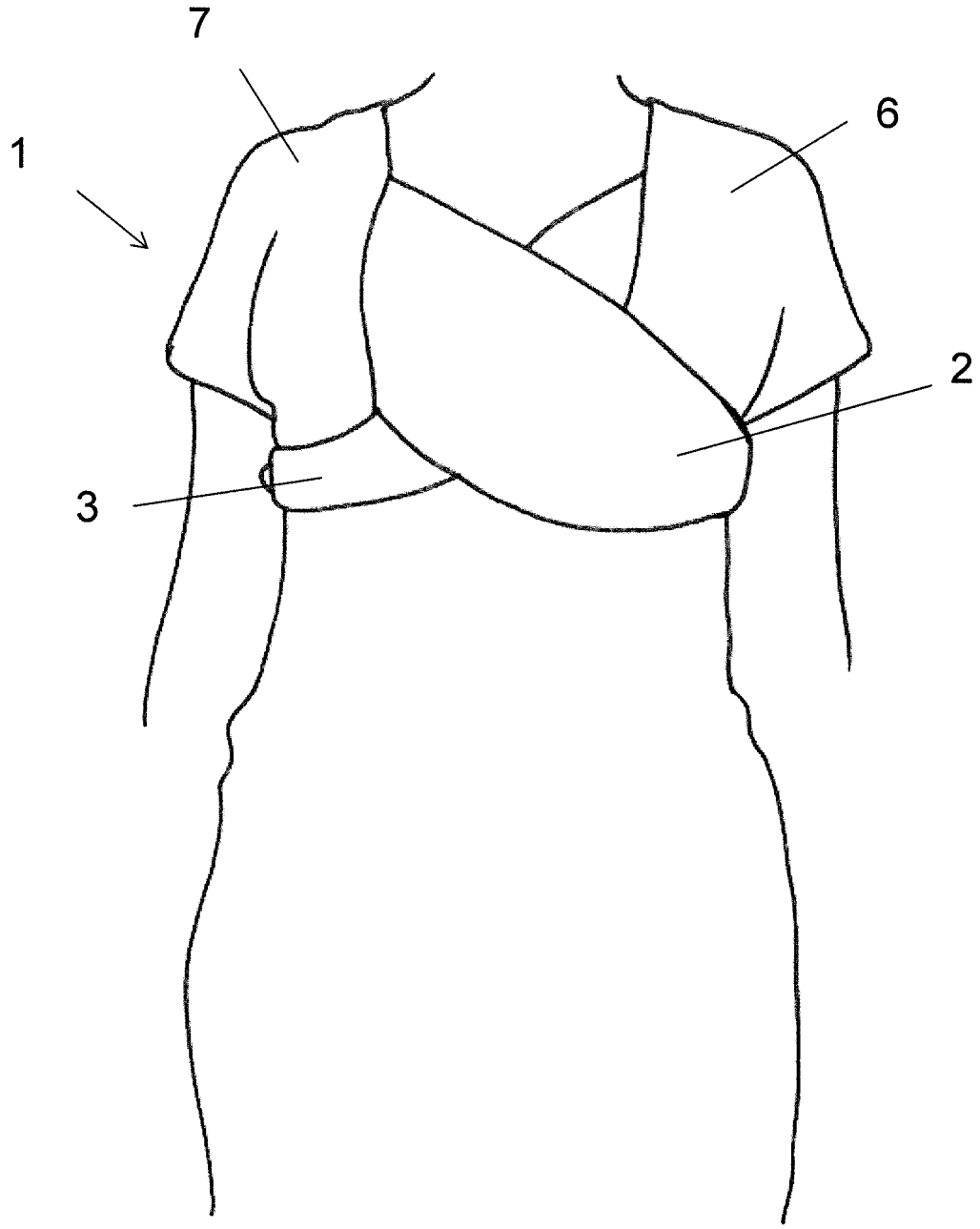
FIG. 1A Outer garment (1) according to a specific embodiment of the present invention. Front view with closed draping flaps (2, 3).

The following reference numerals are used in the description and figures: 1—garment; 2, 3—flap; 4—closing member; 5—opening; 6, 7—top part; 8—proximal part of a flap; 9—distal part of a flap; 10—flap; 11, 12—shoulder end; 13—button; 14—cover element; 15—neckline edge.

DESCRIPTION OF THE INVENTION

As used below in this text, the singular forms "a", "an", "the" include both the singular and the plural, unless the context clearly indicates otherwise.

The terms "comprise", "comprises" as used below are synonymous with "including", "include" or "contain", "contains" and are inclusive or open and do not exclude additional unmentioned parts, elements or method steps. Where this description refers to a product or process which "comprises" specific features, parts or steps, this refers to the possibility that other features, parts or steps may also be present, but may also refer to embodiments which only contain the listed features, parts or steps.

The enumeration of numeric values by means of ranges of figures comprises all values and fractions in these ranges, as well as the cited end points.

The term "approximately" as used when referring to a measurable value, such as a parameter, an amount, a time period, and the like, is intended to include variations of +/−10% or less, preferably +/−5% or less, more preferably +/−1% or less, and still more preferably +/−0.1% or less, of and from the specified value, in so far as the variations apply to the invention disclosed herein. It should be understood that the value to which the term "approximately" refers per se has also been disclosed.

All references cited in this description are hereby deemed to be incorporated in their entirety by way of reference.

Unless defined otherwise, all terms disclosed in the invention, including technical and scientific terms, have the meaning which a person skilled in the art usually gives them. For further guidance, definitions are included to further explain terms which are used in the description of the invention.

The term "outer garment" as used herein refers to a garment which covers at least a portion of the torso of the wearer, and includes garments such as tops, blouses, dresses, tunics and pajamas. More particularly an outer garment will cover a portion of the torso of the wearer which extends both in the front and in the back, covering an area which is significantly larger than the breasts. The outer garments described herein form an outer layer of clothing which typically at least partially covers undergarments such as a bra. Accordingly, the term "outer garment" as used herein does not include a bra.

As intended herein, an object is "elongate" when the length of said object is greater than one and a half times the width of said object; preferably the length is greater than two, three, four or five times the width of the object.

References to "left-hand" or "right-hand" parts of a garment relate to parts of the pieces from the point of view of the wearer. The term "sagittal plane" as used herein refers to a central plane from the back to the front of the garment, dividing the garment in a left and right part. This plane corresponds to the sagittal plane of the wearer when wearing the garment.

The terms "proximal" and "distal", when referring to parts of clothing, have in fact been chosen arbitrarily and are intended to be able to make a distinction between the parts. In the current context, the term "proximal", when relating to an end of a draping flap, refers to the end of the draping flap which is attached closest to a breast during wearing, more specifically the part which is (optionally detachably) fastened to the remainder of the garment above the chest area.

In this context, the term "distal" refers to the other end which is detachably fastened to the remainder of the garment in a region under the chest area.

The present invention relates to breastfeeding attire and the use thereof.

Accordingly, an outer garment is provided, comprising one or more draping flaps which are removably attached to the remainder of said outer garment as to cover and uncover the chest area, wherein said one or more draping flaps are attachable to the remainder of said outer garment in different configurations so as to close the garment, wherein said configurations differ from each other as to the positioning of a proximal or distal end of one of said one or more draping flaps relative to the rest of said outer garment (the latter including the other draping flap, where the garment comprises more than one draping flap). In particular embodiments, an outer garment is provided with either one or two draping flaps.

More particularly the outer garment comprises one or more draping flaps which are removably attached to the remainder of said outer garment as to cover and uncover the chest area, wherein said one or more draping flaps are attachable to the remainder of said outer garment in different configurations to cover the chest area or close the garment. Indeed, the garment comprises alternative options of fastening the flaps to the garment, which can be used as a reminder of which side was last used for breastfeeding. Additionally or alternatively, the alternative options correspond to ways of accessing either the right or left breast for breastfeeding.

More specifically, the present invention provides an outer garment which comprises one or more draping flaps which are removably attachable from the remainder of said outer garment as to (partially) cover and uncover the chest area, wherein said one or more draping flaps are attachable to the remainder of said outer garment in a first and a second configuration wherein:

- each of said first and second configurations is asymmetric with respect to the sagittal plane; and
- said first and second configurations are each other's mirror image with respect to the sagittal plane.

The one or more draping flap of the present garment can be detached. This may allow the user to make a breast is accessible for breastfeeding, though in particular embodiments, alternative slots or mechanisms may be provided to allow access to the breast. Nevertheless, it is thus substantially the one or more draping flaps which cover the breasts, with the remainder of the outer garment typically only partly covering the breasts. The possibility to attach the (proximal or distal end of) one or more draping flaps in two different (asymmetrical) configurations allows for the wearer to use the one or more flaps as a reminder of which side was last used for breastfeeding.

In particular embodiments of the present invention, the breastfeeding attire comprises a pair of draping flaps running across the chest. In specific embodiments, each of the draping flaps is detachably attached on one side to the remainder of the outer garment, so that a breast is made accessible for breastfeeding by detaching a flap. In specific embodiments, the breast may be made accessible as a result of the presence of a slit on the proximal side of the draping flaps. These features will be explained in more detail below.

The outer garment described herein may comprise a pair of draping flaps running across the chest, each having a proximal and distal side or end. The draping flaps typically consist of an elongate piece of cloth. However, the exact shape is not critical. In specific embodiments, the draping flaps have an (irregular, but approximately) triangular or (asymmetric) diamond shape. The proximal side of each flap is attached, optionally detachably, to the remainder of the outer garment and the distal side is attached, optionally detachably, to the remainder of the garment.

In specific embodiments, each of the draping flaps is attached, optionally detachably, on the proximal side to the remainder of the outer garment at the location of a region running along at least a part of the side seam under the underarm up to and including the sleeve opening, each on another side of the garment. In specific embodiments, the proximal side of the flap is attached to the side seam under the underarm at one or more points, and optionally at one or more points at the location of the sleeve opening. In specific embodiments, the flap is attached to the remainder of the garment in an uninterrupted manner on the side seam and at least a part of the sleeve opening.

In specific embodiments, the flap itself is attached to an intermediate piece which ensures attachment to the remainder of the garment. In specific embodiments, this intermediate piece is a piece of cloth which is attached to the remainder of the garment at the location of a region running along at least a part of the side seam under the underarm up to and including a part of the sleeve opening. This embodiment is particularly interesting if the garment is also provided with a slit (as is described in more detail below).

In specific embodiments, the proximal side of the flap is attached to the remainder of the garment at the top, at a level which is at least 4 cm below the shoulder seam. This makes it possible to ensure that the draping flaps do not completely cover the neck after they have been crossed.

As has been indicated above, the proximal side of one flap is attached (optionally detachably) near the left-hand sleeve opening, while the proximal side of the other flap is attached (optionally detachably) near the right-hand sleeve opening. It will be clear to the person skilled in the art that the garment in question may also be a sleeveless outer garment, so that the "sleeve opening" in this case corresponds to the armhole.

Furthermore, the distal side of each of the draping flaps is also detachably attached to the remainder of the outer garment, so that, in the closed position, the draping flaps at least partly cover the chest area. More specifically, the draping flaps cover at least the lower part of the chest area.

Typically, each draping flap covers one of the breasts, with the flap whose proximal side is attached on the right-hand side of the outer garment covering the right-hand breast, and the flap whose proximal side is attached on the left-hand side of the outer garment covering the left-hand breast.

The relative positions of the draping flaps are such that, when attached, they overlap and/or cross one another at least partly and cross the chest area completely or partly. Thus, one flap runs from the left to the right, while the other flap runs from the right to the left.

In specific embodiments, the outer garment described herein is furthermore characterized by the fact that the distal side of each flap is/can be detachably attached via a closing mechanism (consisting of one or more closing members or closure pieces). More specifically, the closing member makes it possible to attach and detach the flap in a reversible manner. Such closing members are known to the person skilled in the art.

Non-limiting closing members comprise a button and buttonhole or a button and loop system, press-studs, and hook and loop fastener. In a preferred embodiment, the closing member comprises a button and loop system. In more specific embodiments, the loop is provided at the distal end of the flap and the button is provided on the garment, usually near the side seam of the garment. This may increase the ease of use and durability of the outer garment. The detachable connection ensures that the draping flaps can be opened in order to make the breasts accessible for breastfeeding. As used herein, the term "open" flap indicates a flap whose distal side has been detached from the remainder of the garment. More specifically, the flap can then be turned further sideward, so that the flap provides access to a breast. The term "closed" flap indicates a flap whose distal side is detachably attached to the remainder of the garment, in which case the flap at least partly covers a breast.

In a preferred embodiment, one side of each flap is detachably attached to the remainder of the outer garment, and the other side is non-detachably attached to the remainder of the outer garment. A non-detachable attachment may be achieved, for example, by sewing on the flap or by making the flap and another part of the outer garment from one piece of cloth. In a preferred embodiment, the proximal side of each flap is non-detachably attached and the distal side is detachably attached to the remainder of the outer garment. The fact that the proximal side of the draping flaps remains attached ensures that the wearer can breastfeed discreetly. However, in specific embodiments, it may be provided that the distal side of the draping flaps is non-detachably attached and the proximal side is detachably attached to the remainder of the garment.

As has been described above, detaching a flap ensures that the outer garment gives access to a breast for breastfeeding. It is thus substantially the draping flaps which cover the breasts, with the remainder of the outer garment typically only partly covering the breasts. In specific embodiments, the outer garment is provided with vertical strips of fabric which run on each side of the garment from the shoulder to below the chest and thus also partly cover the chest area. As described below, each of these strips of fabric usually covers a proximal side of a draping flap.

Since the draping flaps are fastened to the remainder of the garment independently from one another, the order in which the draping flaps overlap one another can be selected freely. This may increase the comfort during wearing and can be used by the wearer to remind her which side was last used for breastfeeding. It is, for example, possible to decide to wear the flap on the side which was last used for breastfeeding on top.

In particular embodiments, the outer garment according to the present invention may be provided with a single draping flap which is at least partially detachable from the remainder of the outer garment, so as to cover and uncover the chest area in a reversible manner. Thus, whereas the left-hand and right-hand draping flap as described above typically each only cover one breast, the single draping flap according to the present embodiments at least partially covers both breasts.

More particularly, the outer garment may have a neckline which at least partially surrounds the chest area so as to allow for access to the breasts for breastfeeding, wherein the chest area is at least covered by a single detachable draping flap. Specifically, the single draping flap is detachably attached to the remainder of the outer garment such that the draping flap at least partly covers the chest area. More specifically, the draping flap covers at least the lower part of the chest area.

The exact shape of the draping flap is not critical. In specific embodiments, the draping flap has an approximately triangular or trapezoidal shape. In particular embodiments, the surface of the draping flap is larger than the surface are to be covered by the draping flap. In such embodiments, the draping flap may provide a plurality of folds when attached to the remainder of the garment, which can increase the comfort during wearing.

The single draping flap comprises left and right shoulder ends for connecting the draping flap to the left and right side of the neckline, respectively, wherein the left and right shoulder ends can independently be positioned on top or behind the edge of the neckline. More particularly, each shoulder end can be positioned, at the choice of the wearer, on the outer or inner surface of the rest of the garment. The term "inner surface" as used herein refers to the surface facing the wearer, whereas the term "outer surface" as used herein refers to the surface facing away from the wearer. This can be used by the wearer to remind her which side was last used for breastfeeding. For example, it is possible to decide to attach the shoulder end on the side which was last used for breastfeeding on the outer surface of the garment and the other end at the inner surface, or vice versa.

The shoulder ends are typically attached to the remainder of the garment in the shoulder area. In specific embodiments, the shoulder ends are attached to the remainder of the garment at the top, on or slightly below the shoulder seam, e.g. about 4 cm below the shoulder seam. More particularly, the shoulder ends may be attached near the adjacent sleeve opening or armhole.

The single draping flap is removably attached to the rest of the garment at a plurality of points surrounding the neckline, preferably 3, 5, 7, or more points. Such attachment can be obtained via closing mechanisms comprising one or more closing members or closure pieces as described above, which make it possible to attach and detach the draping flap in a reversible manner. The closing members are typically positioned along the contour of the neckline, in a regular or irregular way. In preferred embodiments, the closing mechanisms comprise a plurality of press-studs or snap fasteners. This can allow for an easy attachment and detachment of the draping flap. In preferred embodiments, the male parts of the press-studs are provided on the draping flap, whereas the female parts are provided on the remainder of the garment.

In order to allow for attaching the shoulder ends of the draping flap at the inner and outer sides of the garment, the shoulder area of the garment will typically be provided with closing mechanisms at the outer side as well as the inner side of the garment. In preferred embodiments, the closing mechanisms for attaching the shoulder ends which are provided at the outer side of the garment, may be covered by a cover element, e.g. a strip of cloth, or a fold.

Aside from the two shoulder ends, the rest single draping flap is typically only attachable to only one of the sides of the garment, i.e. either the inner side or the outer side. In particular embodiments the draping flap is attachable to the inner side of the garment, i.e. the side facing the wearer. In this way, the plurality of closing mechanisms can be provided discreetly on the inner side of the garment. However, it is envisaged that in certain embodiments, the draping flap may be attachable to the outer side of the garment, i.e. the side facing away from the wearer.

The draping flap may be partially or entirely detachable. In particular embodiments, the single draping flap is partially detachable from the remainder of the garment. More particularly, an upper part of the draping flap may be detachable, whereas a lower part may be non-detachably attached to the remainder of the outer garment. For example, the lower part may be sewn to the remainder of the outer garment.

In preferred embodiments, the single draping flap is entirely detachable from the remainder of the garment. This allows for washing the draping flap separately from the remainder of the garment, such that the garment is easy to maintain. Moreover, this allows for providing the garment with two or more draping flaps as described herein, which are interchangeable. This allows for wearing the garment with one of the draping flaps, while washing the other draping flap. In particular embodiments, the two or more interchangeable draping flaps may have different looks, thus allowing for appropriately adapting the garment to specific situations.

In specific embodiments, the outer garment comprising a single draping flap as described herein is provided with a pair of openings, each of which can give access to a breast without this requiring the garment to have a mechanical opening or closure (including the draping flap described herein). Thus, the openings can give access to the breasts in a simple and discreet manner, without the draping flap having to be detached. In a preferred embodiment, the openings form slits which may be opened in order thus to give access to the breasts. In a preferred embodiment, the openings or slits have a vertical orientation, for example on the side of the breasts next to the underarm region.

In particular embodiments, the openings or slits are created between the single draping flap and the remainder of the garment. For example, the single draping flap may be attached to the remainder of the garment via a plurality of closing mechanisms such as press-studs, wherein the distance between a pair adjacent closing mechanisms is such that a slit is created between these adjacent closing mechanisms. More particularly, the closing mechanisms may be provided such that at least one pair and preferably two pairs (one at the left and one at the right) of adjacent closing mechanisms are further away from each other than other adjacent closing mechanisms, so as to provide an opening or slit as described above. In such embodiments, the draping flap will typically be attached to the remainder of the garment via the inner side of the garment, such that the opening or slit remains hidden. In specific embodiments, the outer garment described herein is provided with a pair of openings, each of which can give access to a breast without this requiring the garment to have a mechanical opening or closure (including the draping flaps described herein). Thus, the openings can give access to the breasts in a simple and discreet manner, without the draping flaps having to be opened. This makes the outer garment described herein suitable for breastfeeding, for example via a breastfeeding bra with a closure at the shoulder or in the centre. The openings may optionally be covered by arranging a piece of fabric in front thereof (as described above).

In a preferred embodiment, the openings form slits which may be opened in order thus to give access to the breasts. In a preferred embodiment, the openings or slits have a vertical orientation, for example on the side of the breasts next to the underarm region.

Typically, the openings are provided on the proximal side of the draping flaps. The draping flaps themselves may be provided with such an opening, for example on the proximal side. If the flap is produced as a separate piece of cloth, it is also possible to configure the connection to the remainder of the outer garment in such a way (e.g. via an intermediate piece as described above) that a slit is created between the flap and the remainder of the outer garment. For example, the proximal side of a flap may be fastened at two points, in which case a slit is created between these points.

In specific embodiments, a closing mechanism is provided on the opening in order to ensure that this opening can only be opened in a controlled manner. In this case, the type of closing mechanism is not critical and may be chosen from mechanisms known from the prior art. Preferably, the closing mechanism is a mechanism which can easily be handled single-handedly, such as for example one or more press-studs, a zip fastener, a hook and loop fastener, etc.

The use of the outer garment described herein is suitable in combination with any (breastfeeding) bra. The openable draping flaps are particularly suitable to breastfeed discreetly using a breastfeeding bra which opens in the centre, as described in European patent EP2375924. However, the outer garment described herein also makes it possible to breastfeed discreetly using a breastfeeding bra which opens at the shoulder.

The outer garment described herein is characterized by the fact that access to the breast can be provided using the one or more draping flaps and/or the vertical openings while only exposing a minimal area of the remainder of the body. After all, in the outer garment described herein, opening the one or more draping flaps and/or the vertical opening only gives access to the breast and the abdominal region remains covered by the remainder of the outer garment. In specific embodiments, the outer garment described herein is provided with a front piece in one piece which covers the entire abdominal region from the chest area down (from side seam to side seam). In specific embodiments, the outer garment is provided with two front pieces which each cover half the abdominal region and can be detachably connected to each other centrally by a closing mechanism in order to make it possible to put on and take off the outer garment without having to pull it over the head via the neck opening.

The draping flaps described herein may be provided on different types of outer garment. As has been described above, the outer garment is usually furthermore provided with a (single-piece or two-part) front piece (at least covering the abdominal region), a (single-piece or two-part) back piece, and optionally sleeves and/or a collar.

In specific embodiments, the outer garment is provided with a left-hand and a right-hand draping flap as described above and two pieces of cloth which extend vertically downwards at the front on each side or from the shoulder line (also referred to herein as top parts). Each of these covers one proximal side of a draping flap. These may run as far as the underside of the outer garment, may be fastened to a front piece under the chest area and/or form a part of the front piece under the chest area. In specific embodiments, these vertical pieces of cloth do not touch one another, however, and an opening is provided in between them which is only covered in the centre at the front by the crossing draping flaps (in the closed position). In specific embodiments, the crossing draping flaps in the closed position cover the connection between the vertical top parts and the (single-piece or two-part) front piece. In specific embodiments of the outer garment described herein, the (single-piece or two-part) front piece is provided with a(n optionally elastic) wrinkle. More specifically, the fastening of the vertical pieces of cloth to the front piece may (also) be provided with a wrinkle. This increases the comfort while wearing during pregnancy or after childbirth.

Non-limiting examples of suitable outer garments are tops, blouses, dresses, tunics and pajamas. In a preferred embodiment, the outer garment is a single-piece garment. In specific embodiments, the system described herein is provided in a tunic or a dress. In this embodiment, the above-described front piece of the outer garment and the back piece are longer, for example, so that they also cover the upper legs at least partly. In particular embodiments, the outer garment extends to at least the waist of the wearer.

The material from which the outer garment described herein is made is not critical. The materials used may comprise both elastic and non-elastic materials. The outer garment may be made, for example, from one or more natural and/or synthetic textile materials, such as cotton, polyester, wool, linen, silk, elastane, etc. The outer garment may also comprise one or more non-textile materials, such as leather and latex.

The present invention will be illustrated by the following non-limiting embodiments.

EXAMPLES

Outer Garment with Two Draping Flaps

FIGS. 1A-E show a specific embodiment of the outer garment described herein.

In this embodiment, the outer garment is a dress. FIG. 1A shows a front view of the outer garment (1), in which the two draping flaps (2, 3) are visible.

Figure 1B:
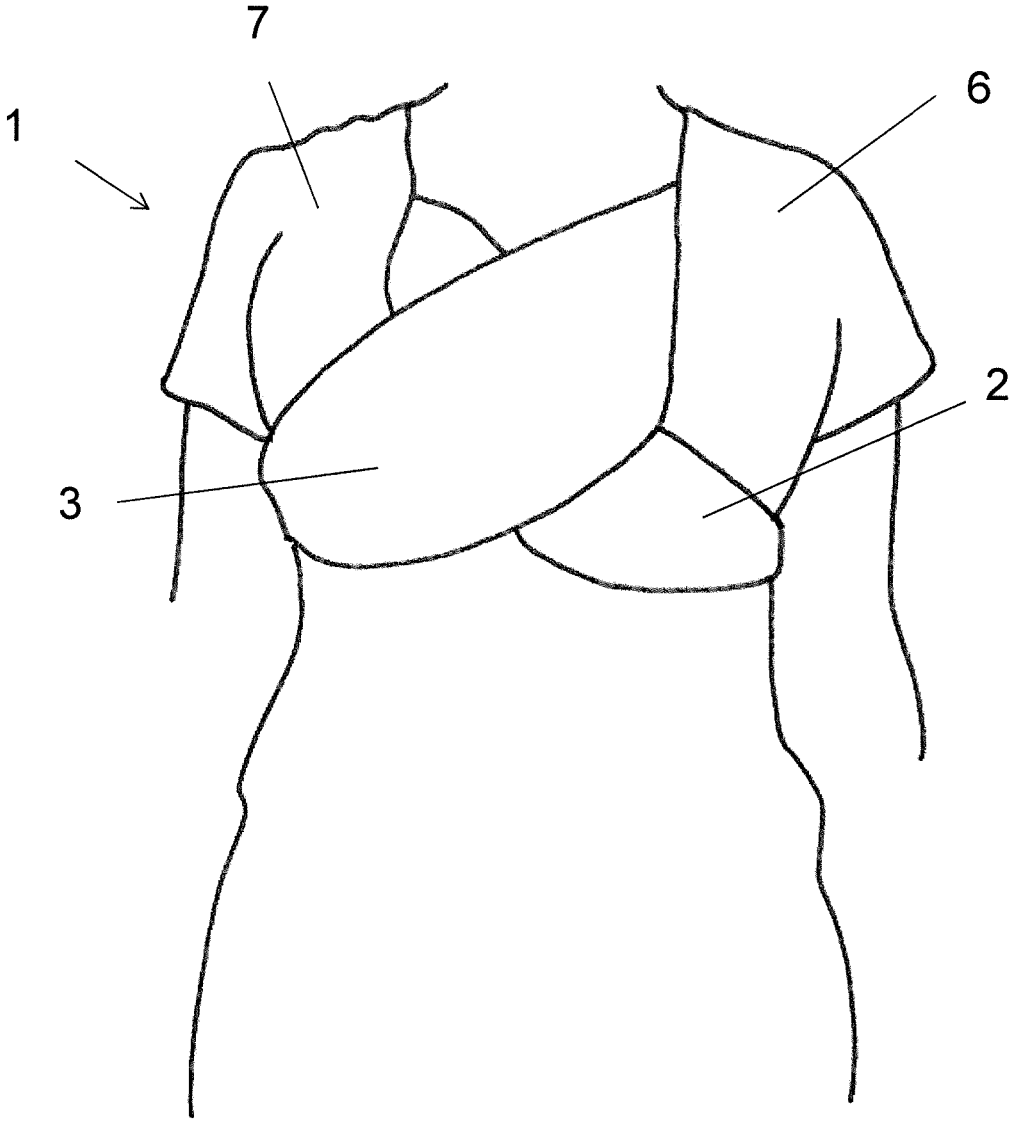
FIG. 1B Outer garment (1) according to a specific embodiment of the present invention in a different configuration than shown in FIG. 1A. Front view with closed draping flaps (2, 3).
Figure 1C:
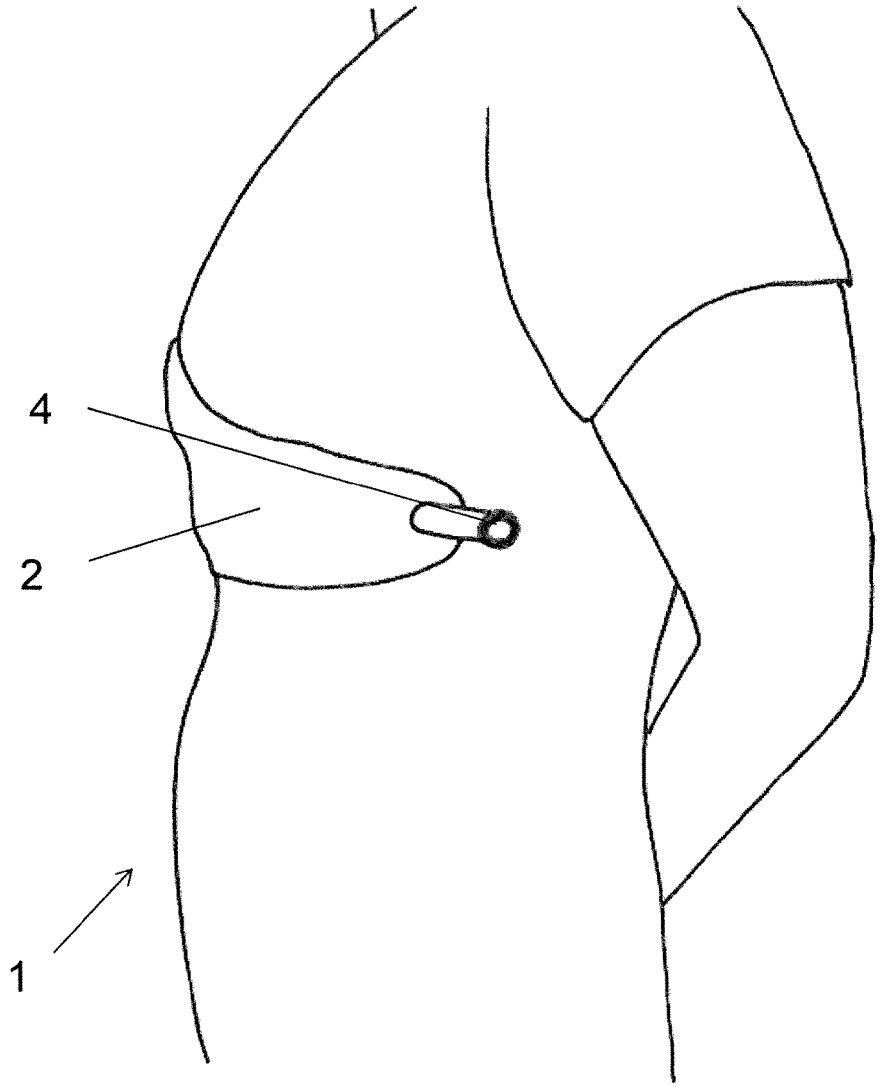
FIG. 1C Outer garment (1) according to a specific embodiment of the present invention. Side view with closed draping flaps (2, 3).

A first flap (2) is fixedly attached to the remainder of the outer garment via the proximal side. The connection is covered by a top part (6). The distal side of the first flap (2) is furthermore detachably attached to the remainder of the outer garment on the left-hand side via a press-stud (4), as is illustrated in FIG. 1C, which shows a side view of the outer garment (1).

The proximal side of the second flap (3) is fixedly attached to the remainder of the outer garment on the left-hand side in a similar way; and the distal side is detachably attached to the remainder of the outer garment on the right-hand side.

The two draping flaps (2, 3) overlap and cross one another. The order in which the draping flaps overlap one another can be changed around, as is illustrated in FIGS. 1A and 1B. In fact, in FIG. 1A, the first flap (2) is situated on top of the second flap (3), while in FIG. 1B, the order is the other way around. The wearer may use this option to serve as an indication which chest was used last for breastfeeding. It is possible, for example, to wear the flap on the side which was last used for breastfeeding on top.

Figure 1D:
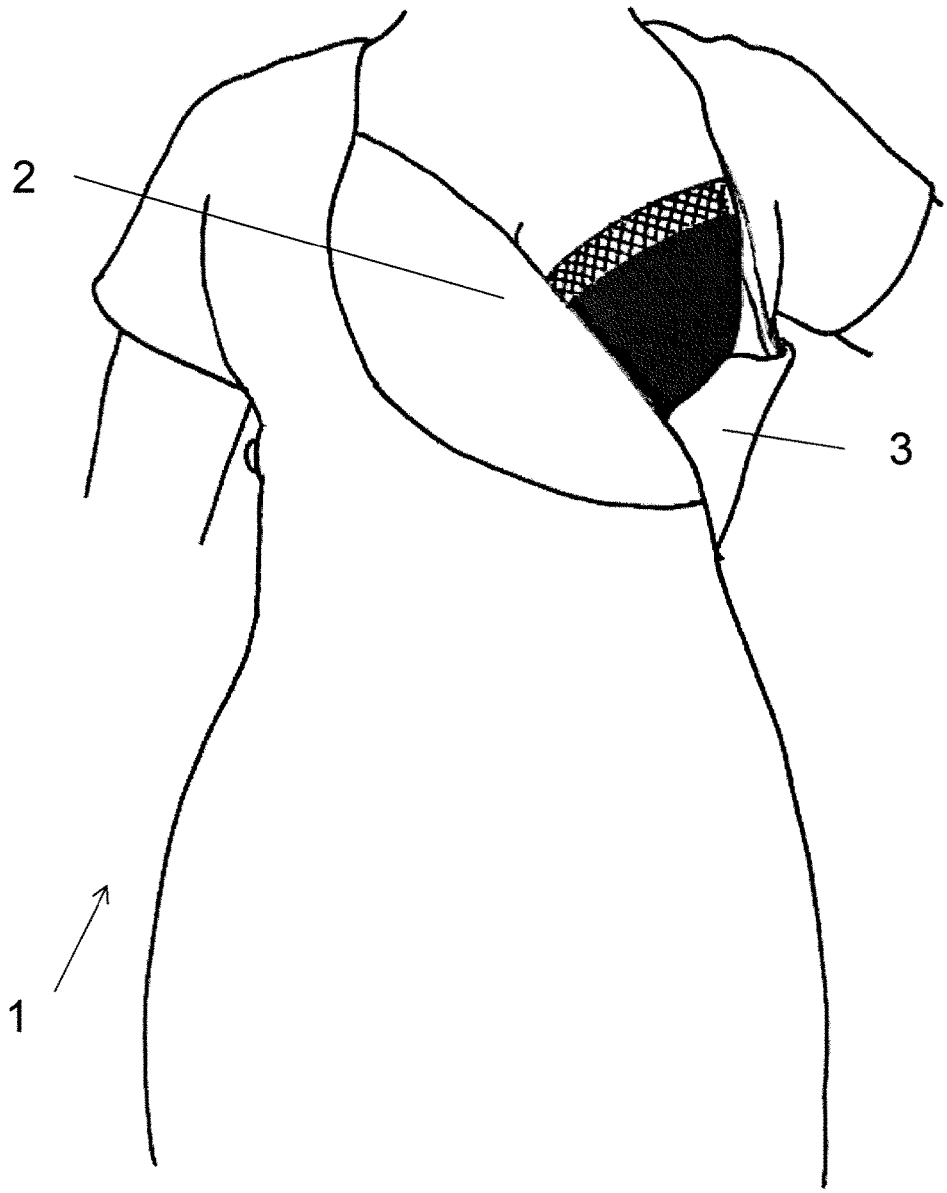
FIG. 1D Outer garment (1) according to a specific embodiment of the present invention. Front view with open flap (3).

The press-studs (4) make it possible to detach the distal side of the draping flaps (2, 3). As a result thereof, the draping flaps can be opened. FIG. 1D shows a front view of the outer garment, with an open flap (3). The open flap gives access to the left-hand breast.

Figure 1E:
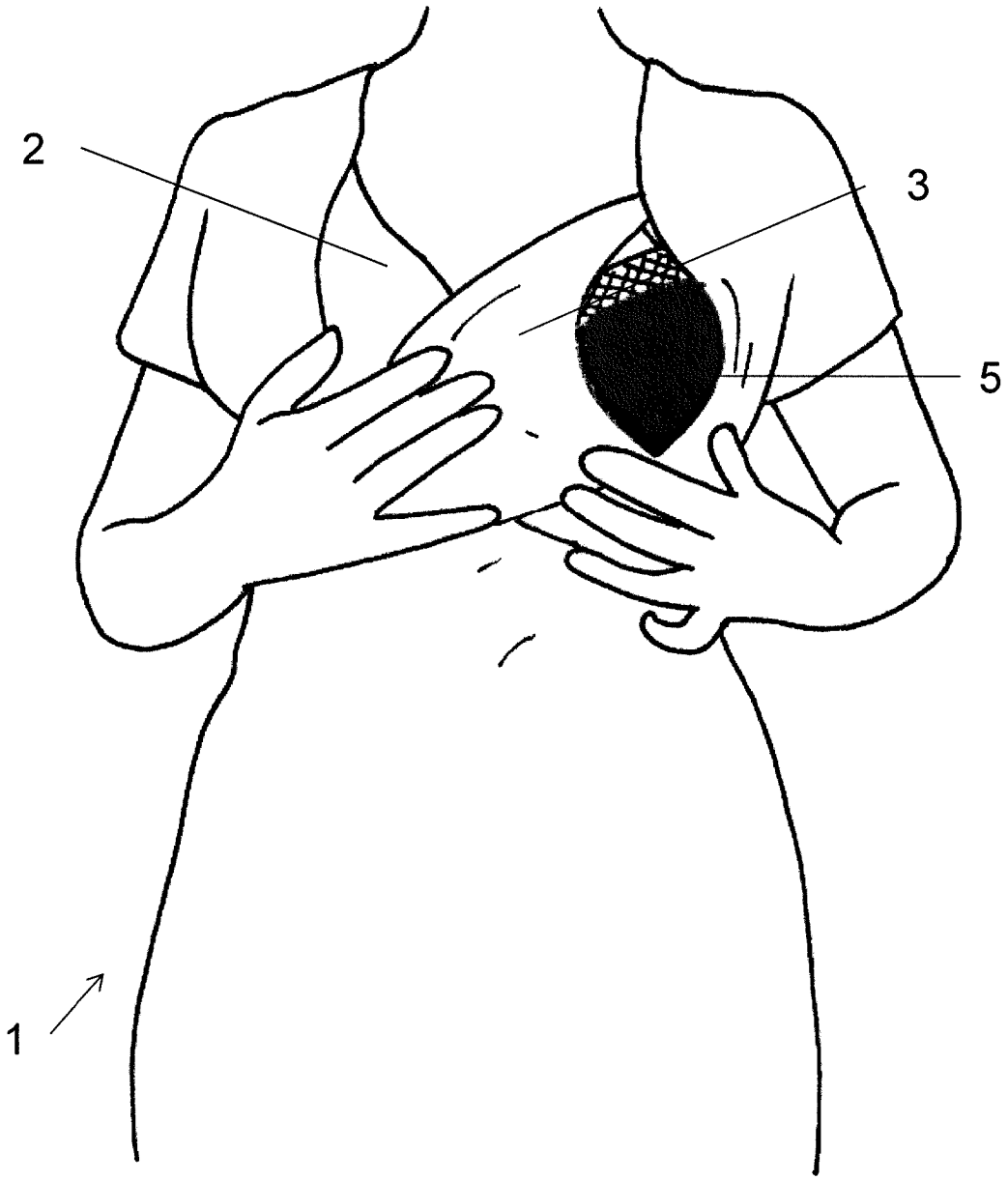
FIG. 1E Outer garment (1) according to a specific embodiment of the present invention. Front view with closed draping flaps (2, 3) and opening (5).
Figure 2A:
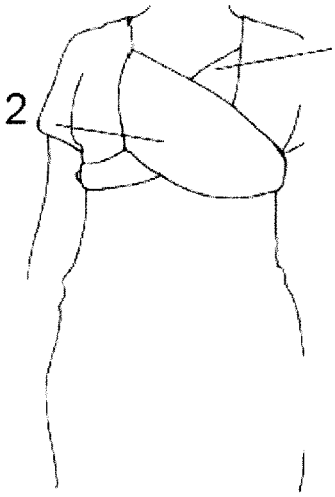
FIG. 2A Diagrammatic illustration of the outer garment shown in FIG. 1A. Front view with closed draping flaps (2, 3).
Figure 2B:
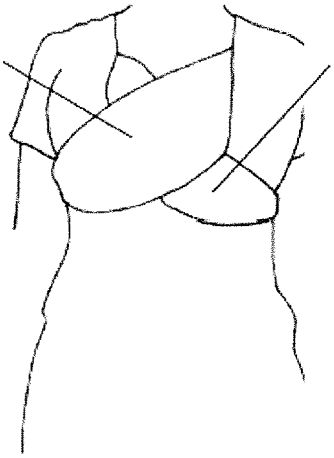
FIG. 2B Diagrammatic illustration of the outer garment shown in FIG. 1B. Front view with closed draping flaps (2, 3).
Figure 2C:
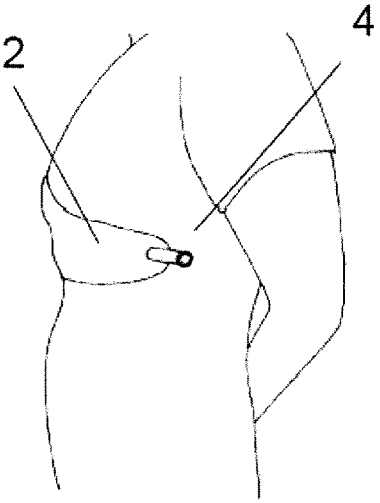
FIG. 2C Diagrammatic illustration of the outer garment shown in FIG. 1C. Side view with closed draping flaps (2, 3).
Figure 2D:
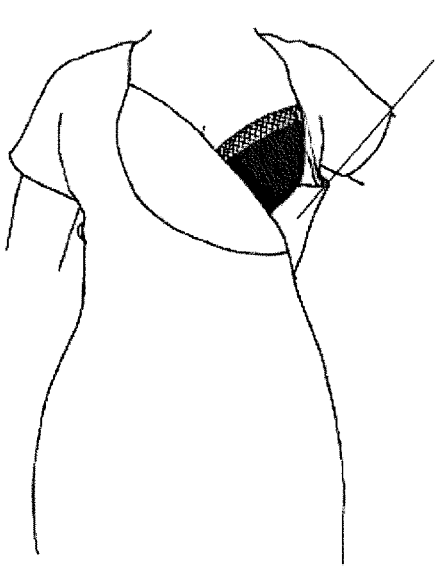
FIG. 2D Diagrammatic illustration of the outer garment shown in FIG. 1D. Front view with open flap (3).
Figure 2E:
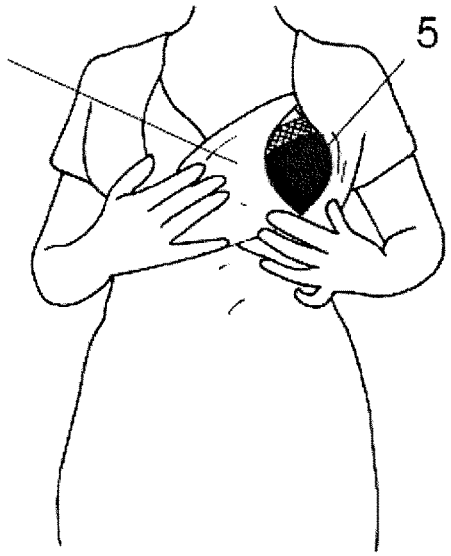
FIG. 2E Diagrammatic illustration of the outer garment shown in FIG. 1E. Front view with closed draping flaps (2, 3) and opening (5).

The outer garment may furthermore comprise a vertical opening (5), on the proximal side of the draping flaps (2, 3). The opening may be opened wide to give access to a breast without opening the draping flaps, as is illustrated in FIG. 1E. This makes it possible to breastfeed discreetly via a breastfeeding bra. The opening (5) may optionally be covered by a top part (6, 7).

FIGS. 2A-E show the above-described specific embodiment in a diagrammatic drawing.

Figure 3A:
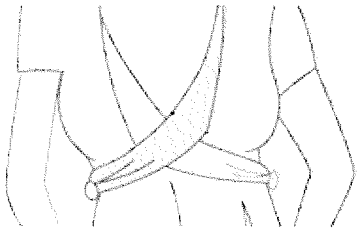
FIG. 3A Use of the outer garment according to a specific embodiment of the present invention. Front view with closed draping flaps.
Figure 3B:
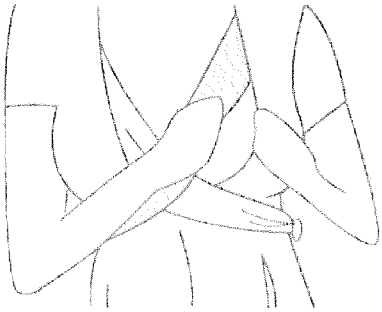
FIG. 3B Use of the outer garment according to a specific embodiment of the present invention. Front view with closed draping flaps, but in which an opening (5) has been made visible.
Figure 3C:
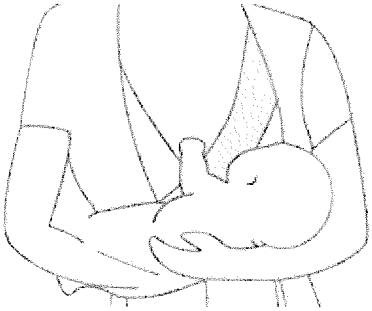
FIG. 3C Use of the outer garment according to a specific embodiment of the present invention. Front view in which the opening (5) on the proximal side of one of the draping flaps is used during breastfeeding.
Figure 4A:
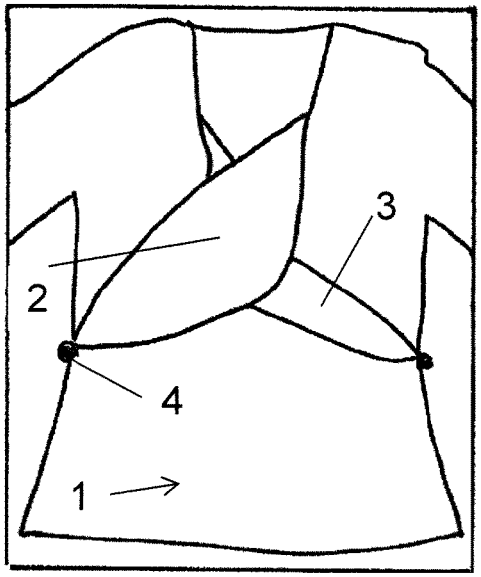
FIG. 4A Outer garment (1) according to a specific embodiment of the present invention. Front view with closed draping flaps (2, 3).
Figure 4B:
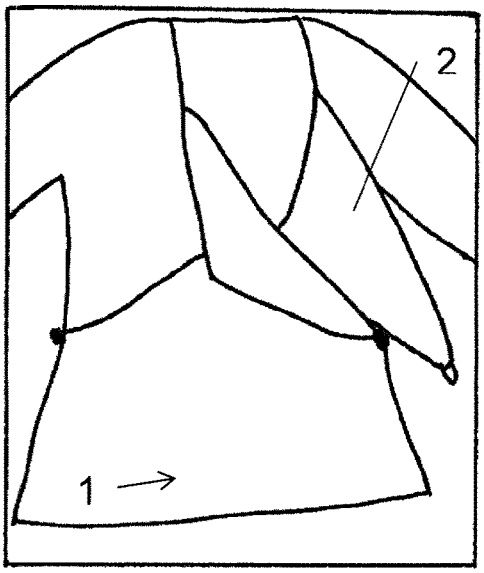
FIG. 4B Outer garment (1) according to a specific embodiment of the present invention. Front view with one open flap (3).
Figure 4C:
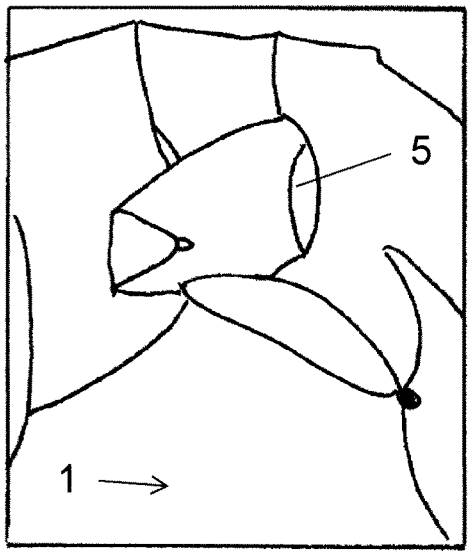
FIG. 4C Outer garment (1) according to a specific embodiment of the present invention. Front view with opening (5).
Figure 4D:
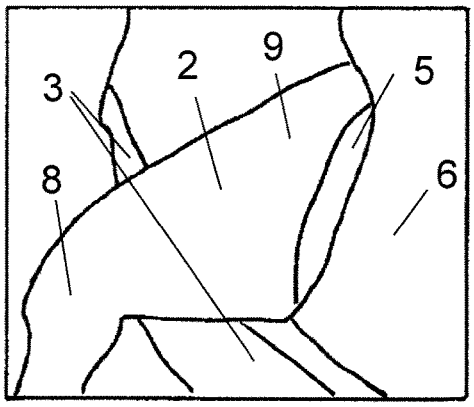
FIG. 4D Outer garment (1) according to a specific embodiment of the present invention. Detail of a flap and attachment to remainder of the garment.

FIG. 3 shows a specific embodiment of the use of the outer garment according to a specific embodiment as described herein. FIG. 3A shows the outer garment when it is being worn normally. In FIG. 3B, the opening on the proximal side of a draping flap is opened. FIG. 3C shows how this opening can be used for breastfeeding.

FIG. 4A-D shows a specific embodiment of the outer garment described herein, in which the outer garment is a top. In FIG. 1A, the top is shown with the draping flaps (2,3) closed and comprising a button and loop system (4). In FIG. 1B, the top is shown with one draping flap (2) folded open. In FIG. 1C, the opening (5) on the proximal side (9) of a draping flap is visible. FIG. 1D is a detail view of the opening (5) on the proximal side (9) of a draping flap. On the edge of this opening, press-studs are provided as a closing mechanism.

Outer Garment with a Single Draping Flap

Figures 5A, 5B:
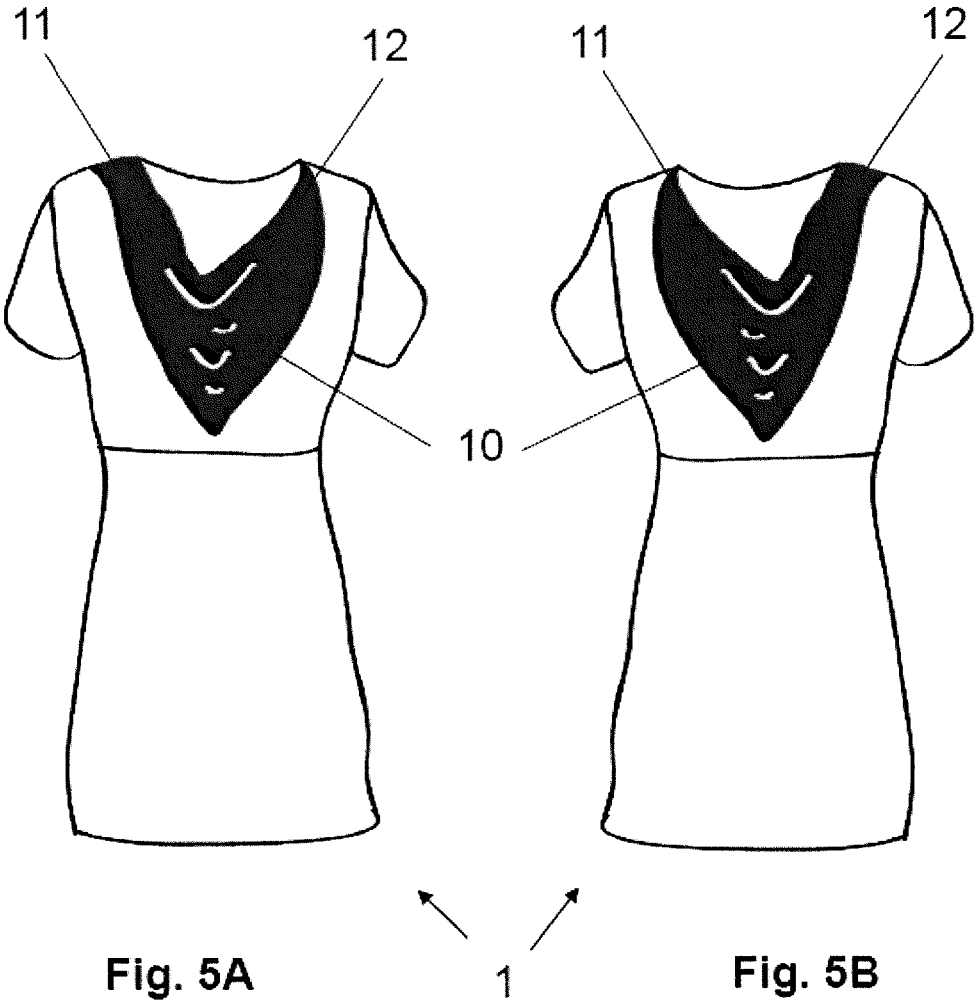
FIG. 5A Front view of an outer garment (1) according to a specific embodiment of the present invention, with a single closed draping flap (10) in one configuration.
FIG. 5B Front view of an outer garment (1) according to a specific embodiment of the present invention, with a single closed draping flap (10) in a different configuration than shown in FIG. 5A.
Figure 6:
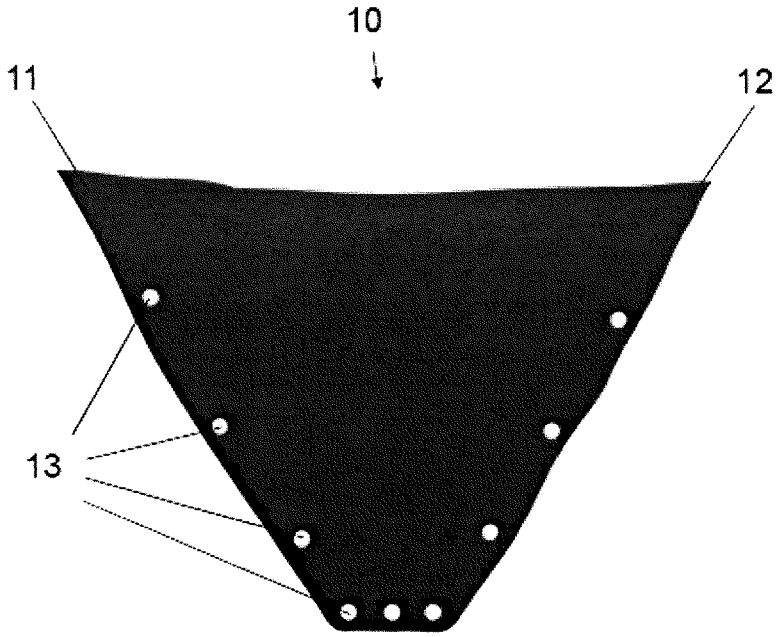
FIG. 6 Draping flap (10) of an outer garment of a specific embodiment of the present invention.
Figure 7A:
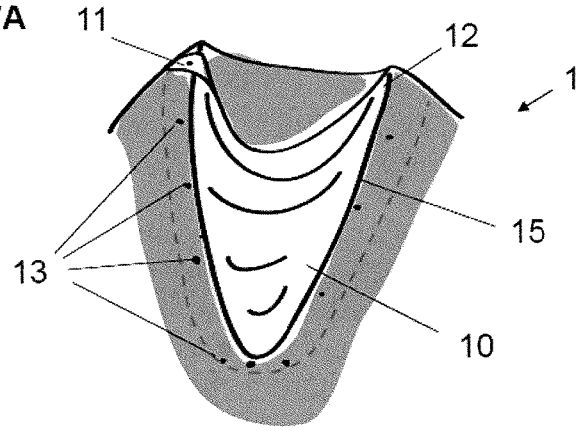
FIG. 7A Detail of the chest area of an outer garment (1) according to a specific embodiment of the present invention, with a single draping flap (10) in one configuration.
Figure 7B:
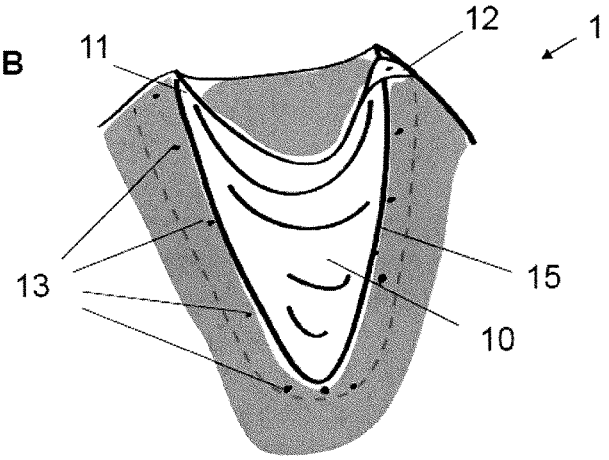
FIG. 7B Detail of the chest area of an outer garment (1) according to a specific embodiment of the present invention, with a single draping flap (10) in a different configuration than shown in FIG. 7A.

FIG. 5A and FIG. 5B show a front view of a specific embodiment of the outer garment (1) described herein. The outer garment (1) comprises a neckline having an edge (15) which surrounds the chest area as to provide access to the breasts for breastfeeding, wherein the chest area is covered by a single removable draping flap (10). In this embodiment, the outer garment is a dress. FIG. 6 shows an illustration of the draping flap (10) and FIG. 7A and FIG. 7B show a detail of the chest area of the outer garment (1) with the single draping flap (10) in two different configurations. In FIG. 6, the outer garment (1) is shown as semi-transparent for clarity.

The draping flap (10) is removably attached to the remainder of the outer garment (1) via a plurality of press-studs (13). The male parts of the press-studs (13) are provided on the draping flap (10) whereas the female parts of the press-studs (13) are provided around the neckline, at the inner side of the garment (1). Accordingly, most of the draping flap (10) is attached to the remainder of the garment behind the neckline. In each of the configurations, one of the shoulder ends (11, 12) of the draping flap (10) is positioned in front of the neckline edge (15), whereas the other is positioned behind the neckline edge (15). The shoulder ends (11, 12) can independently be attached to the remainder of the garment (1) in front of or behind the neckline edge (15), such that two different asymmetric configurations can be obtained which are each other's mirror image, as shown in FIG. 5A-B and FIG. 7A-B. The positions of the shoulder ends (11, 12) relative to the neckline edge (15) can be chosen such as to remind the wearer which breast was last used for breastfeeding.

Figure 8:
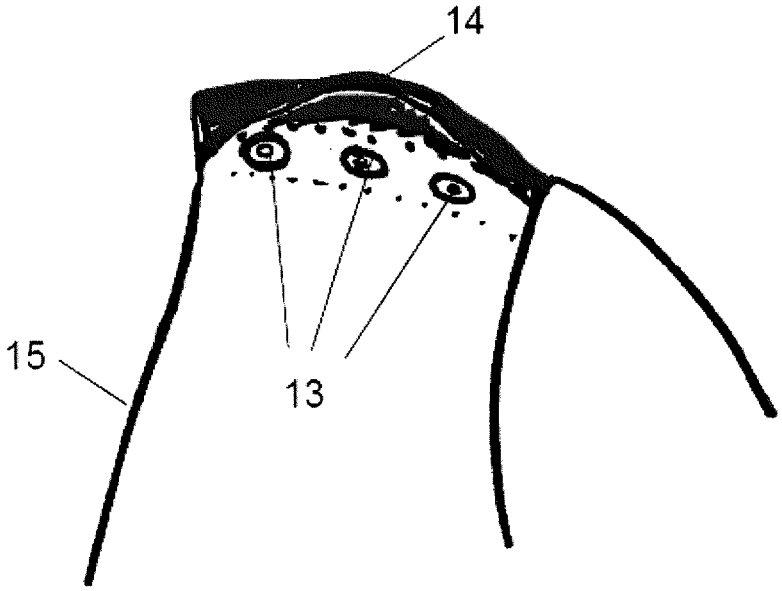
FIG. 8 Detail of the shoulder area of an outer garment (1) according to a specific embodiment of the present invention, provided with press-studs (13) covered by a cover element (14).

Accordingly, the shoulder area of the outer garment are typically provided with closing mechanisms at the outer and at the inner side of the garment. Any closing mechanisms such as press-studs (13) which are provided at the outer side of the garment (1) may be covered by a cover element (14) as shown in FIG. 8.

The invention claimed is:

1. Outer garment, comprising two draping flaps which are removably attached to the remainder of said outer garment as to cover and uncover the chest area, wherein said two draping flaps are attachable to the remainder of said outer garment in different configurations so as to close the garment, wherein said garment comprises a left-hand and a right-hand draping flap which run across the chest, each having a proximal and a distal side; in which the proximal side of said left-hand and said right-hand draping flap is attached to the remainder of the outer garment at one or more points at or around the chest area, the distal side of said left-hand and said right-hand draping flap is detachably attached to the remainder of the outer garment under the underarm region at the opposite breast;

in which said left-hand and said right-hand draping flaps cross one another in the closed position, in which case it is possible both for the left-hand flap to cross on top of the right-hand flap and vice versa, characterized in that the proximal side of said left-hand and/or said right-hand draping flaps or the connection between the proximal side and the remainder of the outer garment is provided with a vertical opening which can give access to a breast for breastfeeding.

2. The outer garment according to claim 1, in which the distal side of each flap is detachably attached to the remainder of the outer garment by means of a closing mechanism.

3. The outer garment according to claim 1, in which said vertical opening is kept closed by a closing mechanism.

4. The outer garment according to claim 1, in which the attachment of the proximal side of said left-hand and right-hand draping flaps to the remainder of the outer garment is hidden from view by the remainder of the garment.

5. The outer garment according to claim 1, in which the outer garment is a single-piece garment.

6. The outer garment according to claim 1, in which the outer garment is a top or a dress.

7. The outer garment according to claim 1, in which the distal side of each flap is detachably attached to the remainder of the outer garment by means of a press-stud, a button and loop combination or a hook and loop fastener.

8. A method for breastfeeding, said method comprising wearing the garment of claim 1 and selecting the order of the overlap of the draping flaps so as to serve as a reminder of which side was last used for breastfeeding.

* * * * *